United States Patent [19]

Hsieh et al.

[11] Patent Number: 4,764,270

[45] Date of Patent: Aug. 16, 1988

[54] SIMULTANEOUS UPGRADING OF TAR SAND BITUMEN AND COAL BY COREFINING

[75] Inventors: C. Richard Hsieh, San Rafael; William I. Donaldson, Orinda, both of Calif.

[73] Assignee: Chevron Research Company, San Francisco, Calif.

[21] Appl. No.: 840,858

[22] Filed: Mar. 18, 1986

[51] Int. Cl.[4] ..... C10G 1/00; C10G 1/06; C10G 45/00; C10G 17/00

[52] U.S. Cl. ..... 208/390; 208/415; 208/418; 208/419; 208/429; 208/430; 208/433; 208/212; 208/254 H

[58] Field of Search ..... 208/390, 415, 418, 419, 208/429, 430, 433, 212, 254 H

[56] References Cited

U.S. PATENT DOCUMENTS

| | | | |
|---|---|---|---|
| 4,001,105 | 1/1977 | Gifford, II | 208/408 |
| 4,076,761 | 2/1978 | Cheng et al. | 208/423 X |
| 4,189,376 | 2/1980 | Mitchell | 208/390 |
| 4,194,964 | 3/1980 | Chen et al. | 208/418 X |
| 4,214,977 | 7/1980 | Ranganathan et al. | 208/423 X |
| 4,298,454 | 11/1981 | Aldridge et al. | 208/420 |
| 4,330,390 | 5/1982 | Rosenthal et al. | 208/413 |
| 4,390,410 | 6/1983 | Acdeh | 208/419 X |
| 4,422,922 | 12/1983 | Rosenthal et al. | 208/430 |
| 4,510,038 | 4/1985 | Kuehler | 208/434 X |
| 4,541,916 | 9/1985 | Beutler et al. | 208/418 |
| 4,610,776 | 9/1986 | Urban et al. | 208/418 |

OTHER PUBLICATIONS

"The K. A. Clark Volume", A Collection of Papers on the Athofasco Oil Sands. K A. Clark, Ed. M. A. Carnigy, Oct. 1963, pub. by the Research Council of Alberta.

*Primary Examiner*—H. M. S. Sneed
*Assistant Examiner*—William G. Wright
*Attorney, Agent, or Firm*—Burns, Doane, Swecker & Mathis

[57] ABSTRACT

An improved tar sands derived bitumen and coal liquification process is disclosed wherein substantial percentages of subdivided coal particles and tar sands derived bitumen liquids are mixed and then corefined with hydrogen under hydrocracking conditions, but in the absence of a separate catalyst, at a temperature range of 800° to 900° F. and a pressure of about 2400 psig. The resutling fluid after removal of residual solids is a suitable liquid feedstock for conventional refinery equipment to produce petroleum fractions useful as transportation and heating fuels. Preferably, a portion of the corefined bitumen-coal liquid product may be recycled for mixture with the bitumen liquid and coal. Raw or native tar sands may also be mixed with the liquid butumen and coal in the process.

14 Claims, 1 Drawing Sheet

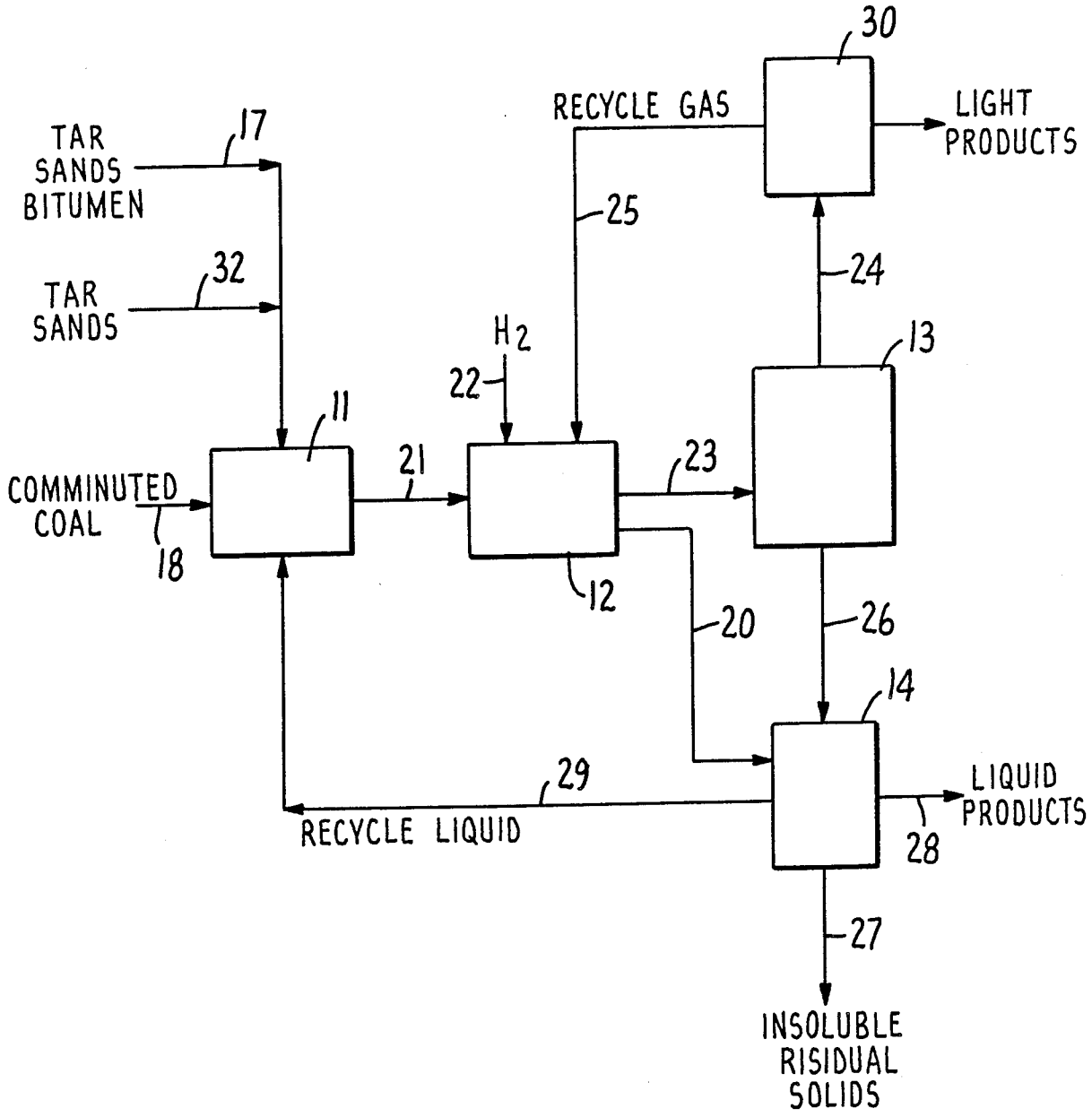
30
RECYCLE GAS
LIGHT PRODUCTS
TAR SANDS BITUMEN
17
25
TAR SANDS
32
24
H2
13
22
11
21
23
COMMINUTED COAL
18
12
20
26
14
29
LIQUID PRODUCTS
RECYCLE LIQUID
28
27
INSOLUBLE RISIDUAL SOLIDS

SIMULTANEOUS UPGRADING OF TAR SAND BITUMEN AND COAL BY COREFINING

BACKGROUND OF THE INVENTION

1. Field of the Invention

The present invention relates to an improved process for simultaneously upgrading tar sand bitumen (organic liquid material) and liquifying solid coal. More particularly, the invention relates to a process wherein bitumen from bitumen-containing tar sands, with or without at least partial separation from the sand, is mixed with a high percentage of solid, comminuted coal particles to form a liquified mixture which is then coreacted only with hydrogen at elevated temperature and pressure. Desirably, but not necessarily, the resultant liquid from such hydrogenated bitumen-coal mixture may be partially recycled as a solvent to remove bitumen from raw tar sands before the liquid bitumen is mixed with the coal.

2. Art of Interest

It is known in the art to produce coal oil by liquification of coal solids in a heavy solvent. It is also known to remove inorganic material from bitumen-containing tar sands using a solvent extraction process. The primary aim of each of these separate solvent liquification processes is to produce a heavy residuum material having distillable fractions without producing excess hydrocarbon gases or coke-like solid material.

In U.S. Pat. No. 4,330,390 to Rosenthal et al. (herein incorporated by reference), the patentees disclose simultaneous upgrading of coal and a heavy petroleum fraction. Finely divided coal is dissolved in a separate petroleum-derived "heavy" solvent such as hydrogenated polycyclic aromatic hydrocarbons as derived from asphaltic or naphthenic crudes in the presence of added hydrogen. The dissolved mixture is then subjected to hydrocracking conditions in the presence of a catalyst and a liquid coal oil effluent is withdrawn. While the process of Rosenthal et al. produces a liquid coal oil having a low specific gravity, low sulfur content, and low nitrogen content, a significant amount of solid residue remains in the product oil, without further refining, which renders the coal oil unsuitable for use as a transportation or heating fuel.

In U.S. Pat. No. 4,189,376 to Mitchell (herein incorporated by reference), bitumen is recovered from so-called tar sands in a vertically-extending solvent extraction zone, wherein a separate solvent for the bitumen (such as high aliphatics or aromatics or higher-boiling synthetic hydrocarbon fractions) is passed through the tar sands-containing extraction zone. A liquid, including the solvent and the extracted bitumen, are removed from the extraction zone. However, the solvent-extracted bitumen is relatively crude and requires significant upgrading in the presence of a catalyst to produce a useful range of hydrocarbon fractions.

U.S. Pat. No. 4,298,454 Aldridge et al. discloses a hydroconversion process for liquification of coal and a hydrocarbonaceous oil to produce liquid hydrocarbons with a minimum of gas production and coke formation. The disclosed hydroconverting process requires an added thermally decomposable metal compound as a catalyst to obtain the required conversion. In control examples where the decomposable metal catalyst was deleted, the hydroconversion of an admixture of tar sands bitumen and subdivided coal produced unacceptably high amounts of coke.

In U.S. Pat. No. 4,214,977, Ranganathan et al. disclose a process for the hydrocracking of a heavy hydrocarbon oil such as the bitumen oils removed from oil sands. The catalyst required for this hydrocracking is a subdivided coal and iron sulfate used in catalytic amounts up to 2 weight percent of the feedstock. In control experiments conducted in the absence of the catalyst, excess solids (coke) were produced and operability of the system was poor.

Canadian Pat. No. 1,160,586—S. E. Moschopedi, discloses a batch process in which a pulverized coal is slurryed in a separate solvent derived from an oil sand bitumen, a deasphalted bitumen, an oil fraction of bitumen, or a hydrotreated coker gas oil. The mixture is heated at 250° to 500° C. for a time long enough to liquify at least some of the coal. High pressure hydrogen is present, and optionally a hydrogenation catalyst. There is no suggestion that a high percentage of the feed is bitumen that is corefined with simultaneous liquification of the coal to form a single synthetic crude suitable as a refinery feed stock without further extensive treatment. The patentee discloses a batch liquification process for the conversion, and does not teach the use of the recovered liquids from the process as a suitable solvent for further liquification of coal.

Additional patents of general interest in the field include:

Johnson—U.S. Pat. No. 4,032,428
Rosenthal et al.—U.S. Pat. No. 4,330,393
Gatsis—U.S. Pat. No. 4,338,183
Rosenthal et al.—U.S. Pat. No. 4,350,582
Rosenthal et al.—U.S. Pat. No. 4,354,920
Dahlberg et al.—U.S. Pat. No. 4,376,037
Dahlberg et al.—U.S. Pat. No. 4,389,301
Ternan et al.—Canadian Pat. No. 1,073,389.

Bitumen may be separated from raw mined tar sands by a number of methods. These include, for example, direct coking of the tar sands, usually at operating temperatures of about 900° F.; anhydrous solvent extraction, usually a light hydrocarbon with recovery of the solvent; cold water bitumen separation; hot water bitumen extraction; and the like. These processes are discussed in more detail in "The Tar Sands of Alberta, Canada" by F. W. Camp, 3rd ed., published by Cameron Engineers, Inc., 1315 S. Clarkson Street, Denver, Colo. 80210 in 1976, which is incorporated herein by reference.

The upgrading of the bitumen once separated usually has two objectives. The first objective is the conversion of froth (a product of some separation processes) to hydrocarbon bitumen. The second objective is the upgrading of the bitumen to a more saleable product generally described as a synthetic crude oil. These processes are described as refining of bitumen (conversion), visbreaking, hydrovisbreaking and refining. These methods are also described in more detail in "The Tar Sands of Alberta, Canada", noted above.

Additional background information and experimental data are also found in:

"Hydrocracking Athabasca Bitumen in the Presence of Coal, Part 1: A Preliminary Study of the Changes occurring in the Coal", by M. Ternan, B. N. Nandi and B. I. Parsons, Canadian Department of Energy Mines and Resources, Mines Branch, Fuels Research Centre, Ottawa, October 1974, Research Report No. R276.

"Hydrocracking of Athabasca Bitumen-Effect of Coal-Base Catalyst on Pilot Plant Operation" by C. P. Khulhe, B. B. Pruden and J. M. Denis, Energy, Mines and Resources, Canada, Canadian Centre for Mineral and Energy Technology, CANMET Report 77-35, January 1977.

"A Comparative Study of Fe Catalysts, $ZnCl_2$ Catalysts and $ZnCl_2$-Promoted Fe Catalysts for Hydrocracking of Athabasca Bitumen" by W. A. O. Herrmann, L. P. Mysak and K. Belinko, Energy Mines and Resources Canada, CANMET Canadian Centre for Mineral and Energy Technology, CANMET Report 77-50, January 1977.

"The Chevron Co-Refining Process", by J. W. Rosenthal, et al., presented at the 49th Midyear Refining Meeting, Session on Heavy Oils Processing, Wednesday, May 16, 1984, New Orleans, La.

The patents and reports described hereinabove require an added catalyst in any subsequent upgrading (i.e., hydrocracking) step. These disclosures do not describe or suggest the present invention of continuously upgrading a combined feedstock of primary separated tar sands bitumen and subdivided coal by contact with hydrogen, but in the absence of added catalyst, preferably with recycling of the liquid product as a solvent for subsequent upgrading of bitumen extraction from the original tar sand or the instant coal-bitumen corefining process.

SUMMARY OF THE INVENTION

In one aspect, the present invention relates to a method for producing a liquid refinery feedstock, by simultaneously reacting tar sands bitumen and solid coal particles comprising the steps of:

(a) admixing substantially percentages of a bitumen-containing and solids-depleted liquid and comminuted coal particles;

(b) subjecting the mixture resulting from (a) to hydrocracking conditions in the presence of hydrogen and without the addition of catalyst to corefine the mixture of bitumen liquid and coal particles to form a solution having minimum gas and residual coal-bitumen solids therein; and (c) separating the upgraded tar sands bitumen-coal liquid produced thereby from the solids as a liquid refinery feedstock.

The present invention produces a low solids, higher gravity liquid oil from such simultaneous reaction of hydrogen with the admixture of unreacted tar sands bitumen and comminuted coal in an efficient and economical manner. The present invention also provides a combined, continuous process for upgrading wide ranges of such an admixture which has substantial percentages of both bitumen from tar sands and coal particles. The resultant product is a synthetic crude oil with improved viscosity, reduced organo-metalic and metal components, and improved H/C ratios.

BRIEF DESCRIPTION OF THE DRAWING

The single FIGURE is a block diagram of suitable apparatus and flow paths for feeding reactant materials and product streams useful in practicing the preferred embodiments of the present invention.

DETAILED DESCRIPTION OF THE PREFERRED EMBODIMENTS

In the illustrated preferred embodiment, solid comminuted coal particles from feedline 18 are mixed with a tar sand bitumen liquid boiling above 400° F. supplied by line 17 and recycle liquid from line 29, to form a pumpable slurry in mixing zone 11. A portion of the non-organic material normally found in tar sands may also be present in the bitumen; they usually pose no problem in the process, and dependent upon their components may even be helpful to the process. Likewise, some of the solvents normally used to extract the organic portions from the inert portions of the tar sands bitumen prior to upgrading of the bitumen may also be present and do not present a problem in the process. Preferably, but not necessarily, a portion of the feed to the system may include a portion of oil or tar sands which have not been previously treated or bitumen extracted therefrom. Such oil sand may be introduced with the feed of comminuted coal particles and slurried with the liquid bitumen feed, and if desired, a portion of the recycled liquid from line 29, produced by the present process.

The slurry from zone 11 passes to a pressure vessel, or zone, 12 via line 21 where the mixture is heated, as by energy supplied to vessel 12 (not shown). At least 50 weight percent of the coal is then dissolved in the bitumen in the presence of hydrogen added from line 22. Such reaction at elevated pressures and temperatures thus produces a relatively low-viscosity liquid product which may be readily separated from any remaining coal residue in columns 13 and 14.

In greater detail, subdivided (comminuted) coal, after being comminuted to particles having a diameter of $\approx$0.006" or less is mixed with separated tar-sand bitumen in zone 11. The basic feedstock for the present invention is a solid subdivided coal such as anthracite, bituminous coal, sub-bituminous coal, lignite, or mixtures thereof. The bituminuous and sub-bituminuous coals are particularly preferred, and it is also preferred that such coals be ground to a particle size smaller than about 100 mesh, Tyler Standard Sieve Size. Larger coal sizes may be processed, e.g., 50–90 mesh (ave. diameter of up to $\approx$0.020"), but such size generally requires longer processing time, higher temperatures, pressures, hydrogen flow rates or combinations of such parameters to achieve comparable results.

The liquid feed will typically comprise separated tar sand bitumen. Preferably, such tar sand bitumen is the solute in a liquid solvent comprising recycled liquid from the present process, i.e., a portion of the liquid mixture of hydrocracked tar sands bitumen and liquified coal. Such liquid bitumen feed may be obtained from numerous materials, but the present invention is particularly directed to the use of a 400° F. or higher-boiling-point separated tar sand bitumen fraction. Because such bitumens also usually contain high percentages of sulfur, nitrogen and metals, they present significantly different and greater problems in refining processes than do most commercial petroleum crudes. The process of the present invention, however, tolerates such higher metals, sulfur and nitrogen, content in the hydrocracking zone, without prior demetallation or pretreatment precautions. Although the reason for tolerance of such high percentages of non-hydrocarbon components is not fully understood, we believe that a substantial portion of the metals of the crude tar sands bitumen bind to or deposit upon the coal residue remaining suspended in the liquid after the hydrocarbon components of comminuted coal particles have been dissolved.

The pulverized or comminuted coal particles are mixed with the bitumen, and if desired recycled liquid, at a coal-to-liquid weight ratio of from about 1:2 to about 1:50.

Another method of describing the feedstock used in the upgrading process of the present invention is that preferably the coal can be as high as about 33% weight, of the reactant feed, i.e., a liquid-to-solid ratio of about 2 to 1. This ratio is particularly preferred because the liquid bitumen feed of the present method is a considerably higher percent of the feedstock than that used in any of processes of the prior art for dissolving coal. Such greater coal content of the reaction mixture contributes to a higher through-put for both coal and tar sand bitumen in the process, resulting in substantially increased efficiency and economy.

From mixing zone 11 the slurry is fed or pumped through line 21 to zone 12, wherein the slurry is heated in the presence of added hydrogen, for example, to a temperature in the range of 800° F. to 900° F., but more preferably from 810° F. to 840° F., for a length of time sufficient to substantially dissolve and liquify the coal in the mixture, at a suitable Slurry Hourly Space Velocity (SHSV), the quantity/unit-volume/hour, as noted below, for such reactions. At least 50 weight percent, and preferably greater than 90 weight percent of the coal, on a moisture- and ash-free basis, is dissolved in zone 12, thereby forming a fluid mixture of bitumen, dissolved coal and insoluble solids, primarily coal residue. Further, it is usually desirable that the reacting coal slurry not be heated to temperatures above 900° F. to prevent excessive thermal cracking, which may substantially reduce the overall yield of normally liquid products.

Hydrogen is introduced into the zone 12 through line 22 and normally comprises fresh hydrogen. It may also include hydrogen-rich recycle gas, as from distillation column 30 through line 25. Other reaction conditions in this zone include, for example, a space velocity of 0.5 to 2 SHSV, preferably 1 SHSV; a pressure in the range of between about 2000 to 2800 pounds per square inch gauge (psig), preferably between about 2100 to 2500 psig, and more preferably about 2400 psig. The physical structure of dissolving zone 12 is such that the slurry may flow upwardly or downwardly in the zone. Preferably, the zone is sufficiently elongated either vertically or horizontally to attain "plug" or non-turbulent flow conditions, which permits maximum residence and mixing conditions of the reactants, particularly beneficial to the process of the present invention.

Zone 12 preferably contains no separate hydrocracking catalyst from any external source for such corefining. However, we believe from results of such corefining performed in accordance with the method of the present invention, that mineral matter contained in the coal itself may in fact act as such a catalyst. It is known that both hydrogenation and cracking occur simultaneously and that the higher-molecular-weight hydrocarbon compounds are converted to lower-molecular weight compounds; at the same time the sulfur compounds are converted to hydrogen sulfide, nitrogen compounds are converted to ammonia, and oxygen compounds are converted to water. The resultant fluid reaction mixture of gases, liquids and insoluble solids preferably passes upwardly through reaction zone 12, but depending upon the physical structure of zone 12, some may also pass downwardly.

In the present embodiment, product effluent from reaction zone 12 is conveyed via conduit 23 and separated in a liquid-vapor zone 13 into a gaseous fraction which may flow to distillation column 30 through line 24. A solids-liquid fraction may be transferred to zone 14 via line 26. Gaseous fractions in line 24 preferably comprise light hydrocarbon fractions boiling below about 120° F. to 250° F. and normally gaseous components such as hydrogen, carbon monoxide, carbon dioxide, water and $C_1$–$C_4$ hydrocarbons. Preferably, hydrogen is separated from the other gaseous components in column 30 and recycled via line 25 to hydrocracking zone 12. The liquid-solids fraction in zone 13 may be fed to solids separation zone 14 which also may receive solid components of the reaction from zone 12 by line 20. Residual insoluble solids are recovered from zone 14 through line 27 after separation from the liquid product removed in line 28. Such solid-liquid separation may be by conventional means, for example, hydrocyclones, filters, centrifugal separators, cokers and gravity settlers, or any combination of such means forming zone 14. For continuous processing, desirably a portion of the liquid from zone 14 is recycled via conduit 29 to serve as at least a portion of the liquid feed to slurry comminuted coal in zone 11. A portion, as noted above, may also be used in conjunction with the bitumen liquid feed as a primary solvent for untreated tar sands that may be introduced into mixing zone 11. Such tar sands may be added through line 32 to the tar sand bitumen feed entering through input line 17.

The comminuted coal feed entering zone 11 through line 18 may also be added to the liquid bitumen feed in line 17 and supplied to zone 11 either before or after mixture with recycle liquid from line 29, or may be fed to line 17 either together with or separately from untreated tar sands from line 32.

The process of the present invention produces normally liquid products. Such normally liquid products, that is, all product fractions boiling above $C_4$, have an API gravity significantly higher than that of the original bitumen and a sulfur content less than that of either coal or bitumen; further, the nitrogen content is less than that of the slurry feed.

The advantages of the present invention will be readily apparent from consideration of the following examples and are not to be considered to be limited thereby.

EXAMPLE 1

A slurry consisting of 25 weight percent River King Coal and 75 weight percent Athabasca Tar Sands Bitumen was passed sequentially through a first stage mixing zone and a second stage dissolver zone in the presence of added hydrogen without added catalyst. The coal was ground to a particle size of less than 100 mesh (Tyler standard sieve) and had the analysis on a weight percent dry basis shown in Table 1. The crude tar sands bitumen liquid comprised a 400° F. fraction having the characteristics as shown in Table 1. This bitumen had been extracted from the raw sands using a hot water extraction process. Hydrogen was introduced into the dissolver at a rate of 10,000 SCF/barrel of slurry. The slurry had an hourly space velocity (HSV) of approximately one in the dissolver which was maintained at a pressure of 2400 psig and a temperature of 825° F. The effluent mixture of gases, liquids and solids was passed to a gas-liquid separator. The liquid product had the properties shown in Table 1.

TABLE 1

BITUMEN AND COAL FEED AND COREFINED PRODUCT INSPECTIONS

| | River King Coal | Athabasca Bitumen | Corefined Product |
|---|---|---|---|
| API Gravity at 60° F. | — | 10.2 | 20.2 |
| C, Wt % | 57.11 | 84.51 | 86.24 |
| H, Wt % | 3.96 | 10.47 | 11.05 |
| O, Wt % | 14.90 | 0.45 | 0.57 |
| S, Wt % | 4.38 | 4.16 | 1.72 |
| N, Wt % | 1.21 | 0.41 | 0.42 |
| H/C | 0.83 | 1.49 | 1.54 |
| Viscosity at 100° C., cSt | — | 46.8 | 2.2 |
| Ni, ppm | — | 75 | 5 |
| V, ppm | 1355 | 167 | 8 |
| Fe, ppm | 3768 | 204 | <3 |
| Coal Conversion, Wt % | 82.8 | — | — |
| 1000+/1000− Yield, Wt % | | 85.8 | — |

Hydrogen Consumption: 875 SCF/bbl.

As can be seen from Table 1, the corefined liquid product has properties which are desirable for a petroleum feedstock for further refining to useful products, including transportation fuels, such as gasoline, kerosene and diesel fuel, or heating fuels for domestic and industrial boilers.

EXAMPLE 2

A portion of the corefined liquid product of Example 1 is used as a solvent for the River King Coal in zone 11. The recycle liquid dissolves the coal better than fresh bitumen and up to 33% coal particles can be added to the liquid for non-catalytic hydrocracking in zone 12.

While the present invention has been described with reference to the specific embodiments thereof, it will be understood by those skilled in this art that various changes may be made and that equivalent steps may be substituted without departing from the true spirit and scope of the present invention. All such modifications or changes are intended to be included within the scope of the following claims.

What is claimed is:

1. A continuous process for simultaneously corefining a mixture of comminuted coal and tar sand bitumen to form a liquid refinery feed stock, having improved hydrocarbon content and viscosity and reduced organo-metallic and metal components, which process comprises:

(a) combining bitumen substantially separated from tar sands with comminuted raw coal at a coal to liquid weight ratio of from about 1:2 to about 1 to 50 to form a slury mixture;

(b) subjecting the slurry mixture resulting from step (a) to hydrocracking conditions in the absence of added catalyst to produce off-gases and a mixture of co-refined bitumen and coal liquid and coal ash residues; and (c) recovering the corefined improve coal-bitumen liquid as a refinery feedstock.

2. The process of claim 1 wherein the coal is comminuted to a size less than 100 mesh (Tyler sieve series).

3. The process of claim 1 wherein the ratio of coal to bitumen is from about 1:3 to about 1:10.

4. The process of claim 1 wherein the ratio of coal to bitumen in step (a) is about 1:3.

5. A process for continuously producing upgraded tar sands according to claim 1, wherein the hydrocracking conditions of step (c) include a temperature of 800° F. to 900° F., a pressure of between about 2000 to 2500 psig and a slurry-liquid hourly space velocity in the range of 0.5 to 2.

6. A continuous process for simultaneously corefining a mixture of tar sand bitumen and comminuted coal to form a refinery feed stream having improved hydrocarbon content and viscosity with reduced organo-metallic and metal components comprising the steps of:

(a) continuously mixing together a feed stream of comminuted raw coal and a solvent feed stream of liquid bitumen tar-sands to form a slurry; said slurry having a coal to liquid weight ratio of from about 1:2 to about 1:50;

(b) feeding the resultant slurry mixture of bitumen liquid and comminuted coal to a hydrogen processing zone;

(c) coreacting said slurry mixture with heat in the presence of hydrogen and in the absence of added catalyst under hydrocracking conditions to produce off-gases and a mixture of co-refined bitumen-coal liquid and coal ash residue;

(d) separating and recovering corefined upgraded bitumen-coal liquid from the insoluble residue as a refinery feedstock; and (e) recycling at least a portion of said corefined bitumen-coal liquid as a part of said solvent feed stream.

7. The process of claim 6 wherein the ratio of coal to bitumen liquid is between about 1:2 and 1:4.

8. A process for continuously producing a liquid of co-refined tar sand bitumen and coal according to claim 6, wherein the comminuted coal particles have a particle size range of less than 100 mesh (Tyler Sieve Series).

9. A process for continuously producing upgraded tar sand bitumen and coal according to claim 6, wherein the hydrocracking conditions of step (c) include a temperature of 800° F. to 900° F., a pressure of between about 2000 to 2500 psig and a slurry-liquid hourly space velocity in the range of 0.5 to 2.

10. A continuous process for simultaneously refining a tar sand bitumen and comminuted coal particles to produce a refinery feedstock having improved hydrocarbon content and viscosity with reduced organo-metallic and metals content which comprises;

(a) continuously feeding streams of comminuted raw coal and a tar-sand derived liquid bitumen into a mixed zone;

(b) mixing said raw coal and tar sand bitumen to form a liquid slurry at a coal to liquid ratio of about 1:2 to about 1:50;

(c) feeding a stream of said liquid slurry to a hydrogen processing zone;

(d) reacting said slurry with hydrogen at a pressure and temperature for hydrocracking reaction of the hydrocarbons therein to generate upgraded hydrocarbon components and residual insoluble solids;

(e) recovering said hydrocarbon components as gases and a liquid stream suitable as a refinery feedstock, including separating said insoluble solids therefrom; and (f) recycling at least a portion of the liquid stream to said mixing zone.

11. The continuous process of claim 10 wherein unprocessed tar sands are added to said mixing zone with said liquid bitumen feed stream.

12. The continuous process of claim 11 wherein said unprocessed tar sands and said comminuted coal streams are added to said bitumen stream before introduction into said mixing zone.

13. The continuous process of claim 10 wherein said stream of comminuted coal is added to said liquid bitumen stream before introduction into said mixing zone.

14. The continuous process of claim 10 wherein said stream of comminuted coal is added to the recycle stream before introduction into said mixing zone.

* * * * *